US005458327A

United States Patent [19]

Crespin

[11] Patent Number: 5,458,327

[45] Date of Patent: Oct. 17, 1995

[54] SWING STICK

[76] Inventor: Michael J. Crespin, 815 50th Ave., Greeley, Colo. 80634

[21] Appl. No.: 334,915

[22] Filed: Nov. 7, 1994

[51] Int. Cl.[6] ..... A63B 67/10; A63B 69/00

[52] U.S. Cl. ..... 273/26 E; 273/58 C; 273/414

[58] Field of Search ..... 273/26 E, 58 C, 273/413, 414

[56] References Cited

U.S. PATENT DOCUMENTS

| | | | |
|---|---|---|---|
| 2,547,776 | 4/1951 | Rankin | 273/26 E |
| 2,842,366 | 7/1958 | Fant | 273/26 E |
| 2,942,883 | 6/1960 | Moore | 273/26 E |
| 3,601,398 | 8/1971 | Brochman | 273/26 E |
| 3,626,502 | 12/1971 | Well | 273/26 E |
| 3,652,088 | 3/1972 | Marsh | 273/26 E |
| 3,731,925 | 5/1973 | Caldwell | 273/26 E |
| 3,953,028 | 4/1976 | Gowins | 273/26 EA |
| 3,994,494 | 11/1976 | Kelley | 273/26 E |
| 4,415,155 | 11/1983 | Goudreau et al. | 273/26 E |
| 4,577,864 | 3/1986 | Aldrich | 273/26 E |
| 5,135,219 | 8/1992 | McKeon et al. | 273/26 E |
| 5,165,682 | 11/1992 | McGuckin et al. | 273/26 E |
| 5,238,241 | 8/1993 | Christensen | 273/26 E |

*Primary Examiner*—William H. Grieb
*Attorney, Agent, or Firm*—Goldstein & Associates

[57] ABSTRACT

The invention is a swing stick, comprising a dowel, a baseball, and a length of rope. The dowel has proximal and distal ends, and a dowel length which is the distance between the proximal and distal ends. The baseball is attached to the distal end by the length of rope, the length of rope is less than the dowel length. The dowel is held horizontally by a pitcher at the proximal end and is reciprocated to cause the baseball to travel in a circular path beneath the dowel. The circular path is brought within a batting path of a batter, who can swing at the baseball. If the baseball is hit, it cannot hit the pitcher.

7 Claims, 1 Drawing Sheet

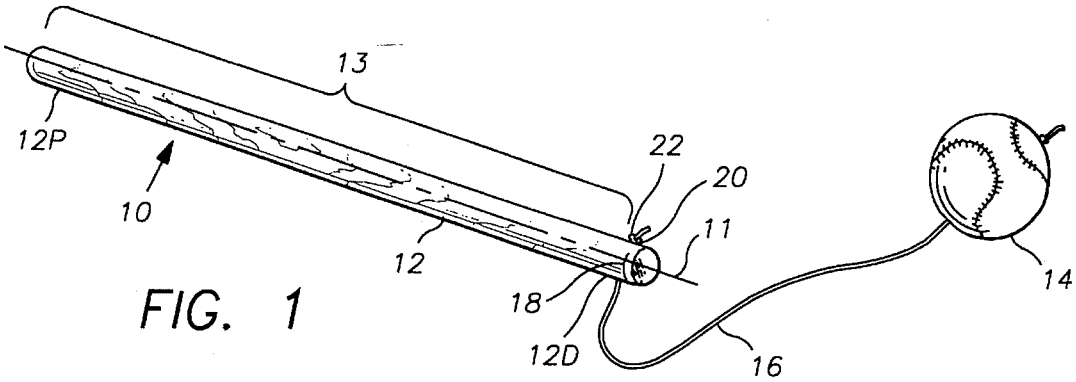
FIG. 1
FIG. 2
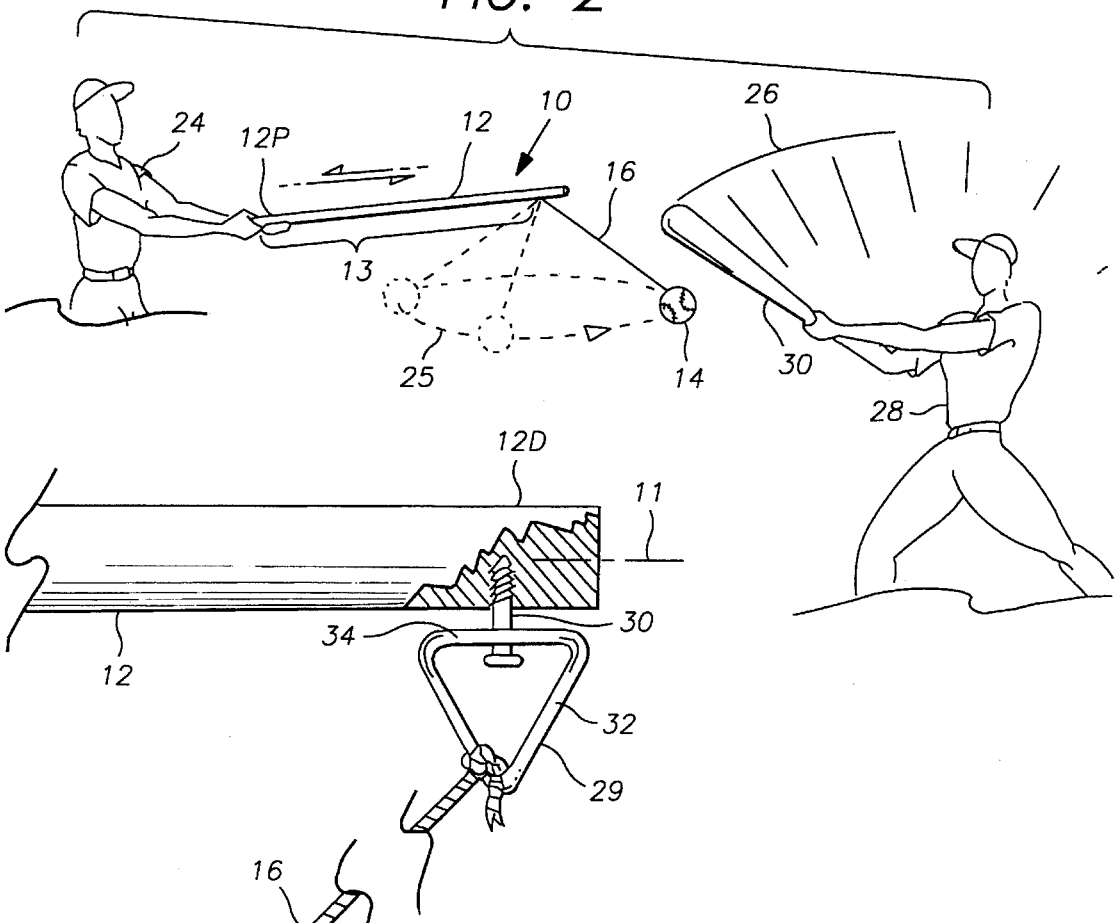
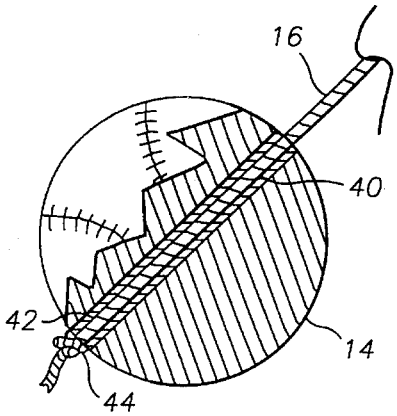
FIG. 3

SWING STICK

BACKGROUND OF THE INVENTION

The invention relates to a swing stick batting practice device. More particularly, the invention relates to a tethered ball batting practice system.

Learning to hit a baseball is a skill that requires considerable practice to attain. One must develop proper band-eye coordination, timing, and strength to become an accomplished hitter. Often, only limited space is available to spend at an actual ballpark or open field developing these skills.

Furthermore, it is often impractical and extremely time-consuming to practice batting in an open field. Balls are hit in a numerous different directions, at great distances, and must all eventually be retrieved and returned to the original batting position before resuming practice. This retrieval process consumes an enormous amount of time as well as energy which could be better spent focused on the batting practice itself.

Also, those not fortunate enough to have a large open field or lot near their homes do not even have the opportunity to take advantage of this inferior method of batting practice. Such individuals are often forced to resort to practicing batting near or around the house. However, batting practice around the home or in populated areas can be hazardous to both persons and property. To compensate for these shortcomings in the area of baseball batting practice, many individuals have attempted to develop a device to allow safe and easy batting practice in any type of environment.

Batting practice sticks of the past have involved a ball, attached to a short stick by a long rope. These sticks are held vertically, and the stick is yanked to whip the ball in the direction of the batter. This creates a severe risk to the batter and the "pitcher". The batter is likely to be hit by the ball when it is whipped uncontrollably toward him by the pitcher holding the stick. However, the greatest risk is to the operator/pitcher, who is in great danger of being hit with the ball after the batter hits it. Since the ball is attached to a rope, as it reaches the end of its travel, it has a tendency to recoil toward the rope origin: the stick which it being held by the pitcher. Indeed, U.S. Pat. No. 4,415,155 to Goudeau et al discloses a batting practice device which explicitly provides for a line which is more than twice the length of the rod- nine feet six inches. U.S. Pat. No. 2,942,883 to Moore discloses a similarly dangerously long :line, which is explicitly described as being seven feet in length. The operator of such devices would obviously be in jeopardy of being struck with the ball once it is contacted by the batter, since the length of the line permits the tethered ball to reach the operator and possibly cause injury.

Furthermore, U.S. Pat. No. 4,415,155 to Goudeau et al and U.S. Pat. No. 2,942,883 to Moore provide for grasping the dowel assembly in a perpendicular fashion. Such operation causes the ball-line assembly to travel in a path which is substantially perpendicular to the dowel, and requires that the dowel be held in front of the operator, thus obstructing his vision.

While these units may be suitable for the particular purpose employed, or for general use, they would not be as suitable for the purposes of the present invention as disclosed hereafter.

SUMMARY OF THE INVENTION

It is an object of the invention to produce a swing stick baseball practice device that allows a batter to safely practice in a confined or populated area without risk of property damage or personal injury to others.

It is another object of the invention to produce a swing stick baseball practice device that eliminates any risk of injury to a pitcher who is operating the swing stick.

It is a further object of the invention to provide a swing stick baseball practice device that enables a person to efficiently, quickly and effortlessly practice baseball hitting, without the inherent loss of time or energy associated with the need to retrieve hit balls in the more traditional methods of baseball batting practice.

It is yet a further object of the invention to provide a swing stick that is economical to manufacture, and is durable for a long useful lifetime.

The invention is a swing stick, comprising a dowel, a baseball, and a length of rope. The dowel has proximal and distal ends, and a dowel length which is the distance between the proximal and distal ends. The baseball is attached to the distal end by the length of rope, the length of rope is less than the dowel length. The dowel is held horizontally by a pitcher at the proximal end and is reciprocated to cause the baseball to travel in a circular path beneath the dowel. The circular path is brought within a batting path of a batter, who can swing at the baseball. If the baseball is hit, it cannot hit the pitcher.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 1 is a diagrammatic perspective view of a first embodiment of the invention.

FIG. 2 is a diagrammatic elevational view of the instant invention in use.

FIG. 3 is an elevational view, with parts broken away, illustrating a second embodiment of the invention.

DETAILED DESCRIPTION OF THE PREFERRED EMBODIMENTS

FIG. 1 illustrates a swing stick 10. The swing stick 10 has a dowel 12. The dowel 12 has a proximal end 12P and a distal end 12D, connected by a proximal-distal axis 11. A baseball 14 is attached to the dowel 12 by a length of rope 16. The length of rope 16 is attached to dowel 12 at the distal end 12D.

In the first embodiment as illustrated in FIG. 1, the dowel 12 may have a dowel bore 18 at the distal end 12D, extending transverse to the proximal-distal axis. The dowel bore 18 has a dowel bore exit 20. The length of rope 16 extends through the dowel bore 18, and is knotted at the dowel bore exit 20, forming a dowel knot 22. The dowel knot 22 may be covered with a sealant to prevent it from fraying or un-knotting. Making sure that the dowel knot 22 does not become un-knotted is crucial for two reasons: it lengthens the useful life of the swing stick 10; and it prevents a potential injury caused by the baseball 14 suddenly flying free of the dowel 12. The dowel 12 has a dowel length 13, which is measured from the proximal end 12P to the distal end 12D.

FIG. 2 illustrates the swing stick 10 is use. The dowel 12 is being held at its proximal end 12P by a pitcher 24. The pitcher 24 holds the dowel 12 horizontally, and is reciprocating the dowel 12 to cause the baseball 14 to travel in a circular path 25 beneath the dowel 12, the circular path 25 substantially parallel to the dowel 12. While maintaining the circular path 25 of the baseball 14, the pitcher 24 can move the swing stick 10 so the circular path 25 of the baseball 14 intersects a potential batting path 26 through which a batter 28 would swing a bat 30. While observing the baseball 14, and attempting to time its travel, the batter 28 eventually swings the bat 30 to hit the baseball 14. If the swing is unsuccessful and the bat 30 fails to contact the baseball 14, the circular path 25 continues, and the batter 28 may again, without delay, attempt to hit the baseball 14. If the batter 28 succeeds in hitting the baseball 14, the baseball 14 travels safely away from the batter 28 in the direction of the pitcher 24, but cannot hit the pitcher 24 because of the relative dowel length 13 and length of rope 16.

It is crucial that the length of rope 16 is shorter than the dowel length 13, so that there is no possibility that the baseball 14 can hit the pitcher 24, as long as the pitcher 24 grasps the dowel 12 near its proximal end 12P.

FIG. 3 illustrates a second embodiment of the invention, in which the length of rope 16 is attached to the distal end 12D with a swivel assembly 29. The swivel assembly 29 comprises a transverse pin 30, which extends into the dowel 12 at the distal end 12D transverse to the proximal-distal axis 11. A connector 32 has three sides, including a first side 34 which is parallel to the proximal-distal axis 11 of the dowel 12. A rectangular frame, square frame, or round loop may also be employed as a connector. The transverse pin 30 is attached to the first side 34 of the connector 32, so that the connector 32 may rotate on the transverse pin 30, with the first side 34 remaining parallel to the proximal-distal axis 11, thus preventing the length of rope 16 from crimping, kinking or tangling as the baseball 14 travels in its circular path 25.

Also illustrated in FIG. 3, and also present in the first embodiment, the baseball 14 has a baseball bore 40, the baseball bore 40 having a baseball bore exit 42. The length of rope 16 extends through the baseball bore 40 and is knotted at the baseball bore exit 42, forming a baseball knot 44. The baseball knot 44 may be coated or sealed to prevent it from fraying or un-knotting. Once again, the length of the rope 16 must be chosen so that the baseball 14 can never reach the proximal end 12P, where the pitcher 24 holds the dowel 12.

In conclusion, a system has been presented for safely practicing baseball in a confined area.

What is claimed is:

1. A swing stick, for baseball practice by a pitcher and a batter, the batter holding a bat, comprising:

a baseball;

a length of rope attached to the baseball;

a dowel having a proximal-distal axis, a proximal end and a distal end, the proximal end held by the pitcher, the dowel has a dowel bore at the distal end that is transverse to the proximal-distal axis, the length of rope extends through the dowel bore, the dowel having a dowel length from the distal end to the proximal end which is greater than the length of the rope so that the pitcher may move the dowel to direct the ball toward the batter, the baseball and length of rope traveling in a circular path, without the possibility of the pitcher being hit by the ball after it is struck by the batter.

2. The apparatus as recited in claim 1, wherein the baseball has a baseball bore extending therethrough, the baseball bore has a baseball bore exit, the length of rope extends through the baseball bore and is knotted at the baseball bore exit, and the knot is covered with a sealant or coating to prevent fraying or un-knotting.

3. The apparatus as recited in claim 2, wherein the dowel bore has a dowel bore exit, and the length of rope is knotted at the dowel bore exit, the knot covered with a sealant or coating to prevent fraying or un-knotting.

4. The apparatus as recited in claim 2, further comprising a transverse pin extending from the distal end of the dowel, a connector, the transverse pin attached to the connector so that the connector can rotate on the transverse pin, the length of rope attached to the connector, thus preventing the length of rope from tangling, kinking or crimping as it travels in its circular path.

5. The apparatus as recited in claim 4, wherein the connector further comprises a triangle frame having three sides, the transverse pin attached to one of the sides of the triangle which is parallel to the proximal-distal axis of the dowel.

6. A batting practice method, conducted by a batter having a bat and a pitcher with a swing stick, the swing stick is a dowel having proximal and distal ends, a ball attached to a length of rope, the length of rope also attached to the distal end, comprising the steps of:

holding the dowel horizontal by the pitcher, the pitcher holding the distal end;

creating a swinging motion of the ball in a circular path beneath and parallel to the dowel by reciprocating the dowel by the pitcher; and directing the circular path near the batter, so that the batter can swing the bat toward the baseball.

7. The method as recited in claim 6, wherein the dowel is of a length that is longer than the length of rope so that if the batter swings the bat at the baseball and hits the baseball, there is no possibility that the baseball can hit the pitcher while the pitcher holds the dowel.

* * * * *